US005244160A

United States Patent [19]

Hinchliffe et al.

[11] Patent Number: 5,244,160

[45] Date of Patent: Sep. 14, 1993

[54] BOBBIN TRANSPORTATION ARRANGEMENT

[75] Inventors: Malcolm G. Hinchliffe, Macclesfield, United Kingdom; Sandro Salmoiraghi, Monza, Italy

[73] Assignees: Rieter-Scragg Limited, Macclesfield, United Kingdom; Salmoiraghi Srl., Monza, Italy

[21] Appl. No.: 761,374

[22] Filed: Sep. 18, 1991

[30] Foreign Application Priority Data

Sep. 27, 1990 [GB] United Kingdom ..... 9021041

[51] Int. Cl.[5] ..... B65H 67/06

[52] U.S. Cl. ..... 242/35.5 A

[58] Field of Search ..... 242/35.5 A, 35.5 R; 57/281

[56] References Cited

U.S. PATENT DOCUMENTS

| | | | |
|---|---|---|---|
| 3,811,631 | 5/1974 | Mayer et al. | 242/35.5 A X |
| 3,987,974 | 10/1976 | Mayer | 242/35.5 A |
| 4,615,493 | 10/1986 | Teranishi et al. | 242/35.5 A |
| 4,688,300 | 8/1987 | Langen et al. | 19/159 A |
| 4,720,967 | 1/1988 | Guttler | 242/35.5 A X |
| 4,730,733 | 3/1988 | Kawamura et al. | 242/35.5 A X |
| 4,834,308 | 5/1989 | Maccaferri | 242/35.5 |
| 4,840,124 | 6/1989 | Tadashima | 104/163 |
| 4,854,439 | 8/1989 | Ueda | 242/35.5 A X |
| 4,881,693 | 11/1989 | Mista | 242/35.5 A |
| 4,923,132 | 5/1990 | Hirai et al. | 242/35.5 A |
| 4,940,127 | 7/1990 | Kikuchi et al. | 242/35.5 A X |

FOREIGN PATENT DOCUMENTS

| | | |
|---|---|---|
| 0144652 | 6/1985 | European Pat. Off. . |
| 0220200 | 11/1986 | European Pat. Off. . |
| 0240473 | 10/1987 | European Pat. Off. . |
| 0297333 | 1/1989 | European Pat. Off. . |
| 0342527 | 11/1989 | European Pat. Off. . |
| 1380470 | 1/1975 | United Kingdom . |
| 1387536 | 3/1975 | United Kingdom . |
| 2129452 | 5/1984 | United Kingdom . |
| 2236768 | 4/1991 | United Kingdom . |

*Primary Examiner*—Stanley N. Gilreath

*Attorney, Agent, or Firm*—Oblon Spivak, McClelland, Maier & Neustadt

[57] ABSTRACT

A bobbin transportation arrangement, in combination with one or more yarn processing machines, includes a track on which a plurality of bobbin carriers run to transport empty tubes from a store to the machine and wound packages from the machine to another store. The track is elevated in regions remote from the machine, but has inclined sections adjacent each end of the machine connecting with a lower track extending adjacent a side of the machine, whereby bobbin receiving pegs on a bobbin carrier are at the same height as the wound packages on the machine. A control device on the machine determines that packages have been wound on a side of the machine and initiates successive despatch of the required number of bobbin carriers to that machine side, where a transfer device locates the bobbin carriers successively adjacent the yarn processing positions, transfers wound packages from the package winding cradles to the bobbin carriers and replaces them with empty tubes.

18 Claims, 5 Drawing Sheets

BOBBIN TRANSPORTATION ARRANGEMENT

FIELD OF THE INVENTION

This invention relates to an arrangement for the transportation of wound packages or bobbins from, and possibly empty tubes to, a textile machine, for example from and to a yarn processing machine.

DESCRIPTION OF THE RELATED ART

It is customary to use trucks for the transportation of large numbers of bobbins away from a yarn processing machine to a package receiving or storage area. Such an arrangement requires either a lot of manpower or large, complicated prime movers for the trucks, both of which are costly. Furthermore the use of ground trucks and manual handling often leads to package damage, and a considerable amount of space is required around the machine to accommodate the ground truck system. It is particularly advantageous to avoid manual handling of the packages when automatic doffing of the packages from the machine is provided.

SUMMARY OF THE INVENTION

It is an object of the present invention to provide a bobbin transportation arrangement, for the transportation of a large number of bobbins from a yarn processing machine, which avoids or lessens by a significant amount the above mentioned disadvantages.

The invention provides a bobbin transportation arrangement in combination with at least one yarn processing machine having means for winding packages of yarn onto tubes at a plurality of yarn processing positions disposed along a lengthwise side of the machine, comprising track means and a plurality of bobbin carriers each adapted to travel therealong, the track means being disposed to pass adjacent the lengthwise side of the machine and each bobbin carrier having at least one bobbin receiving means, and also comprising first transfer means operable to transfer at least one bobbin from the machine to a bobbin receiving means when a bobbin carrier is located adjacent a yarn processing position, and control means operable to determine that packages are wound on the tubes disposed at the yarn processing positions, and to initiate travel of the plurality of bobbin carriers in sequence to the machine to receive the bobbins and to transport those bobbins from the machine.

The arrangement may comprise a package receiving station, and may also comprise second transfer means operable to transfer a bobbin from a bobbin carrier to the package receiving station when that bobbin carrier is adjacent the package receiving station. Preferably the first transfer means is operable, when a bobbin carrier is located adjacent a yarn processing position, to transfer at least one bobbin from the machine to that bobbin carrier and to transfer an equal number of empty tubes from that bobbin carrier to the machine. In that case the arrangement may comprise third transfer means operable to transfer at least one empty tube from an empty tube supply station to a bobbin carrier when that bobbin carrier is located adjacent the empty tube supply station.

The control means may be operable to determine the time to initiate the travel of the first of the plurality of bobbin carriers to the machine, the time interval between each of the successive bobbin carriers, and the number of bobbin carriers required by the machine at that time. The control means may also be operable to ensure that a predetermined maximum number of bobbin carriers can travel along the track adjacent a longitudinal side of a machine at any one time.

Preferably the number of bobbin receiving means possessed by the plurality of bobbin carriers despatched to the machine in response to operation of the control means is equal to the number of wound packages present at the yarn processing positions, and this may be equal to the number of package winding means disposed at the side of the machine.

Each bobbin carrier, each yarn processing position, each side of a machine and each machine of a plurality of machines in a plant, may have a respective identification means. In that case, the first transfer means may be operable to sense and record the identification of each bobbin carrier to which bobbins are transferred from the machine, and of the yarn processing position, machine side and machine from which that bobbin has been transferred. The bobbin carrier identification means may comprise an identification plate having a plurality of holes therein, which may be arranged in two rows to represent a binary number. The first transfer means may have proximity switches operable to sense the presence or absence of holes in the identification plate.

The yarn processing machine may have package winding means disposed in a plurality of rows extending along the side of the machine, in which case each bobbin carrier may have at least one bobbin receiving means in respect of each row. The rows may be substantially vertically spaced and the bobbin receiving means may be disposed with substantially vertical spacing corresponding with that of the rows. The machine may have package winding means disposed in three rows, and may be a yarn texturing machine.

The machine may have a drive end and a control end, and the bobbin carriers may travel adjacent a lengthwise side of the machine from the control end towards the drive end. The first transfer means may transfer bobbins from yarn processing positions adjacent the control end and subsequently from positions nearer the drive end.

The machine may have yarn processing positions on two opposed sides thereof, in which case the track means may be disposed to pass adjacent both sides of the machine. The control means may be operable to sense that the yarn processing positions on one side of the machine contain wound packages and to direct the plurality of bobbin carriers to that side of the machine.

The track means may be elevated to a first height in the regions remote from the machine and may pass adjacent the or both sides of the machine at a second height at which the or each bobbin receiving means is substantially at the same height as a package winding means of the machine. The second height may be less than the first, elevated, height. In that case, the track means may comprise an inclined section disposed adjacent each end of the machine. The transportation arrangement may comprise drive means for each bobbin carrier, which may comprise toothed wheel driving means operable to engage toothed track means at least along the inclined sections. Each bobbin carrier may depend from the track means, and may comprise a pivot whereby the bobbin receiving means on a bobbin carrier remain depending from the track means with substantially constant vertical spacing therebetween as the bobbin carrier traverses the track means and the inclined sections thereof. In that case, latching means may be provided to locate a depending bobbin carrier in a position adjacent a yarn processing position. The latching means may be operable between a bobbin carrier and the first transfer means.

Each bobbin receiving means may comprise bobbin retaining means operable to restrict displacement of a bobbin from the bobbin receiving means whilst the bobbin carrier is in motion along the track means.

BRIEF DESCRIPTION OF THE DRAWINGS

The invention will now be described further with reference to the accompanying drawings in which.

DESCRIPTION OF THE PREFERRED EMBODIMENTS

Figure 1:
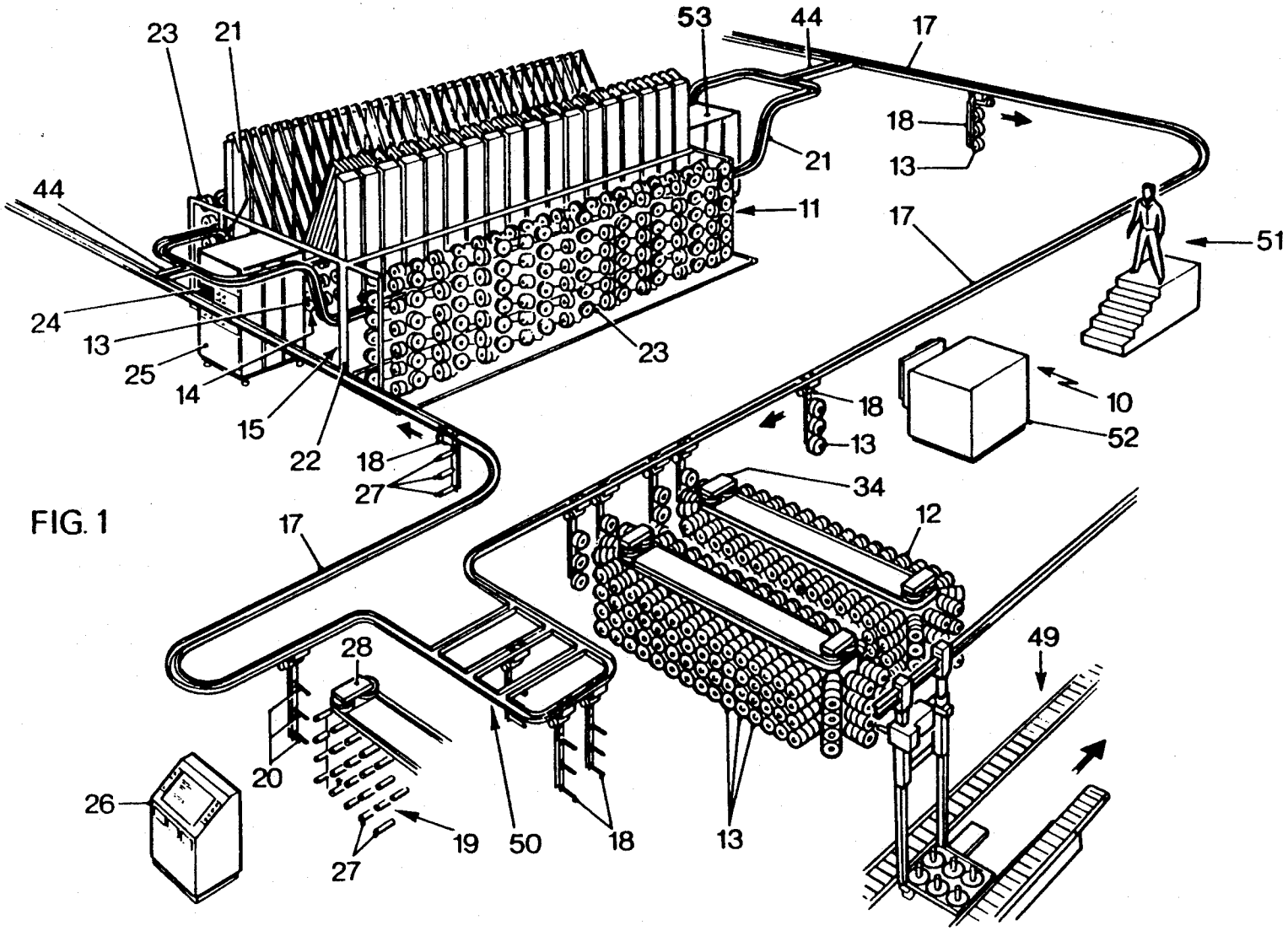
FIG. 1 is schematic view of part of a factory installation incorporating one embodiment of a transportation arrangement according to the invention in combination with a yarn texturing machine.
Figure 2:
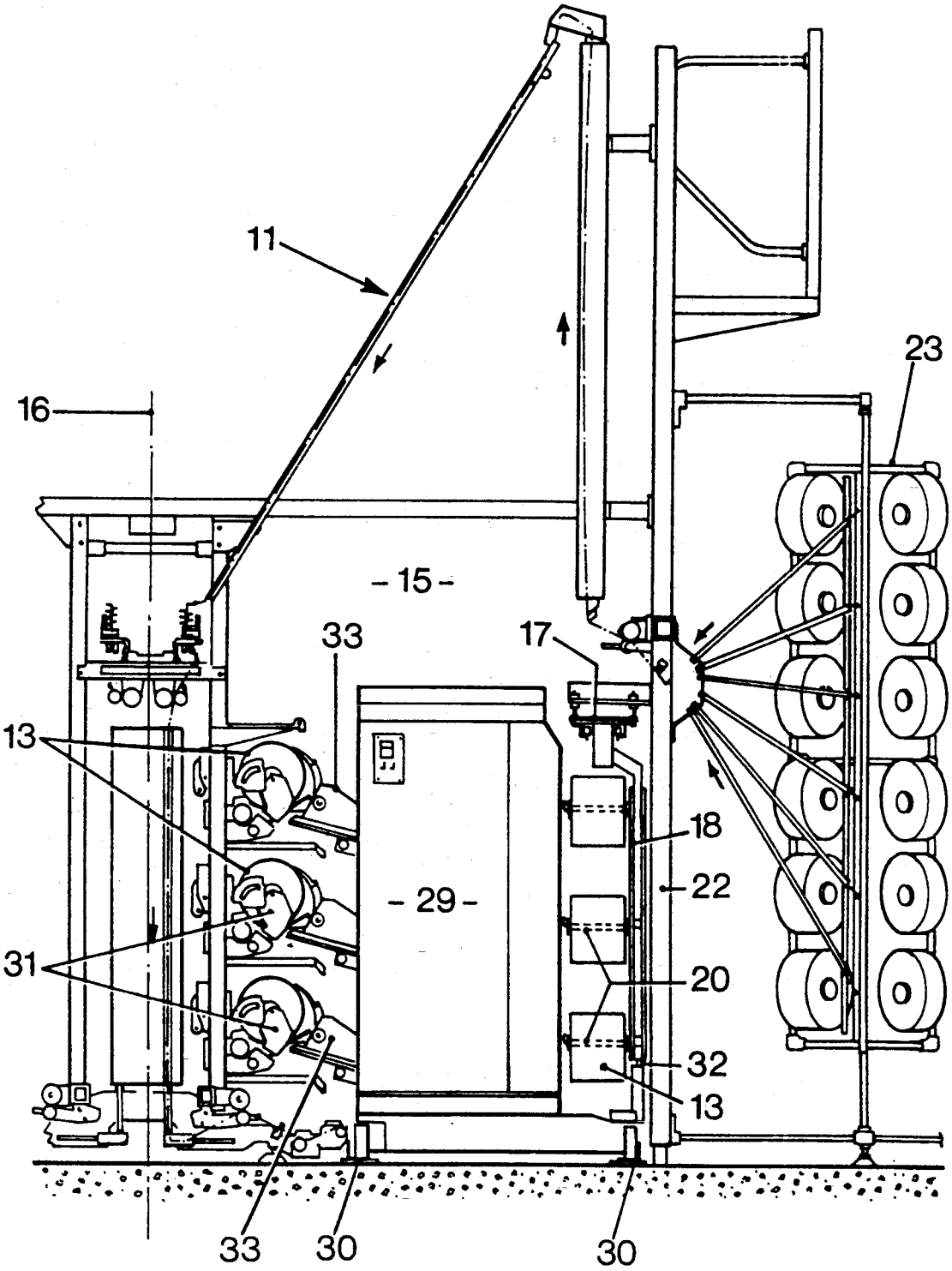
FIG. 2 is an end view of the machine of FIG. 1 showing a transfer means for transferring bobbins between the machine and a bobbin carrier.

Referring now to FIG. 1 there is shown a transportation arrangement 10 for the transportation of wound packages or bobbins from a yarn processing machine 11 to a package receiving station 12. The machine 11 has means for winding packages 13 of yarn at a plurality of yarn processing positions 14 disposed along a lengthwise side 15 of the machine 11. Typically, in the case of a yarn false-twist texturing machine 11, there may be 108 yarn processing positions disposed along a side 15 of the machine, and at each set of three adjacent yarn processing positions 14 the yarns may be wound onto packages 13 disposed one above the other in three vertically spaced rows extending along the machine 11, as shown in FIG. 1 and more clearly in FIG. 2. The machine 11 is double-sided, side 15 being repeated on the other side of the machine centerline 16.

The transportation arrangement 10 comprises a track 17 which is elevated in the regions between the machine 11 and the package receiving station 12. Mounted on the track 17 to depend therefrom are a plurality of bobbin carriers 18, which are adapted to travel along the track 17 between the machine 11 and the bobbin receiving station 12. The track 17 is disposed to pass adjacent the side 15 of the machine 11 and an empty tube supply station 19, as well as the package receiving station 12. Each bobbin carrier 18 has three bobbin receiving pegs 20 having the same vertical spacing as the rows of packages 13 on the machine 11. In the region of the side 15 of the machine 11, the track 17 is lower than it is in regions remote from the machine 11, so that the pegs 20 on a bobbin carrier 18 are at substantially the same height as the packages 13 on the machine 11 whilst the bobbin carrier 18 passes along the side 15, see FIG. 2. To provide such an arrangement, the track 17 has inclined sections 21 at each end of the machine 11, and between the inclined sections 21, is secured to the machine frame 22 approximately midheight of the creel 23. In the regions remote from the machine 11 the track 17 may be supported in its elevated disposition from the floor by pillars, (not shown) or from the roof of the factory (not shown) as desired.

Operation of the machine 11 is controlled by an individual programmable control device 24 housed in the control end 25 of the machine 11. The operational speed of the machine 11 and the length of time for package winding can be pre-set on the control device 24, which will then determine when the packages 13 at the side 15, or the other side as the case may be, of the machine 11 are sufficiently wound. A signal is then sent from the individual control device 24 to a plant programmable control device 26. The individual control devices 24 of each of the machines in the plant are coupled to the plant control device 26, although FIG. 1 only shows one such machine 11 for reasons of simplicity. The rail 17 does however extend to all of the machines in the plant which require package removal. When the plant control device 26 receives a signal from an individual control device 24, it signals the despatch of a sufficient number of bobbin carriers 18 in sequence to the control end 25 of the machine 11 concerned. In the embodiment shown each bobbin carrier has one column of three pegs 20, and as a consequence 36 bobbin carrier visits to the machine 11 will be required for removing 108 packages. This may be arranged as 36 carriers visiting once each, 18 carriers visiting twice, or any other combination of number of carriers times number of visits per carrier, as desired. If two or more columns of pegs 20 are provided on each carrier 18, then the number of carriers or visits per carrier may be reduced by a factor of two or more as appropriate.

Figure 3:
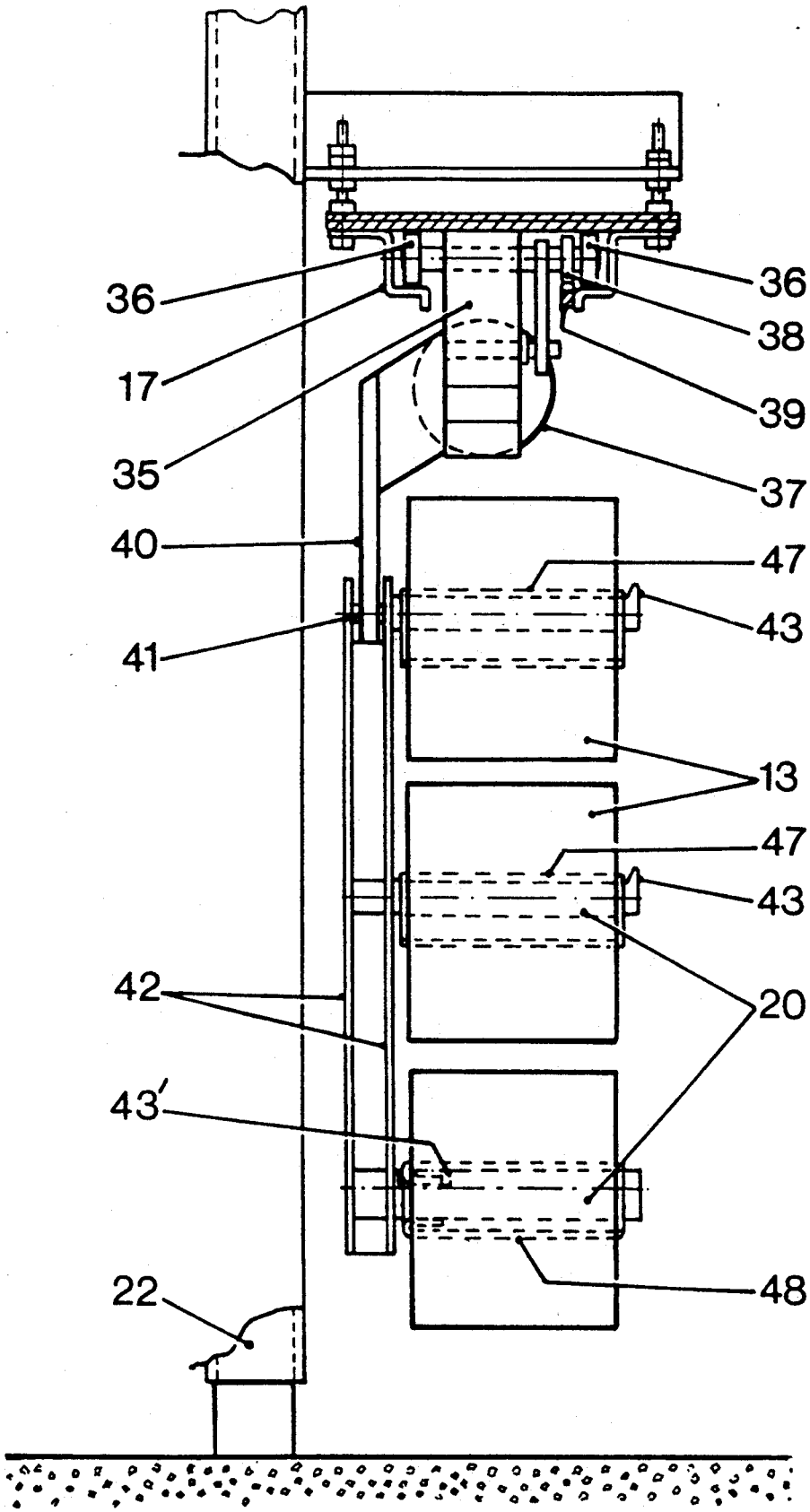
FIG. 3 is a front view of a bobbin carrier.
Figure 4:
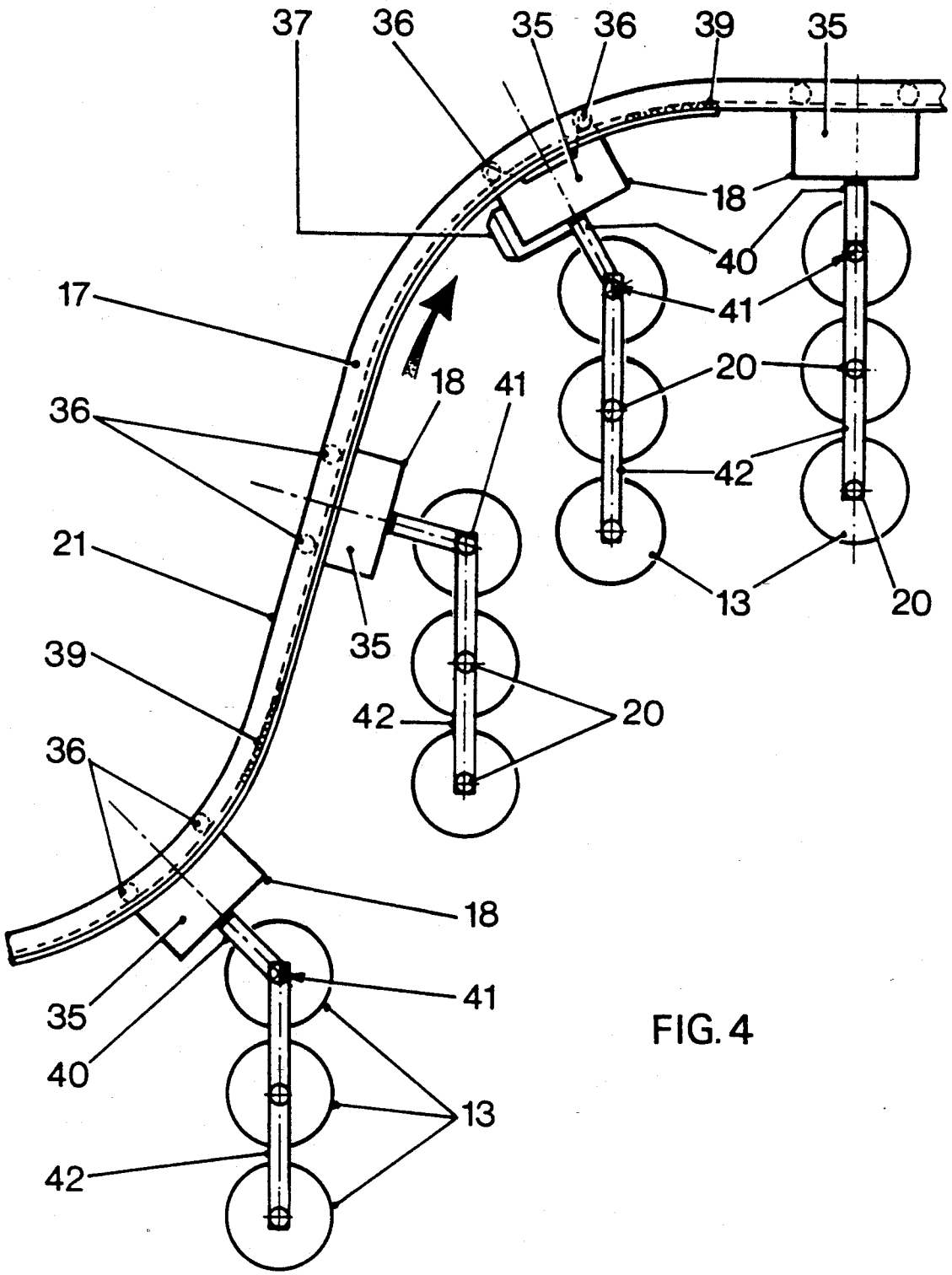
FIG. 4 is a side view of the inclined section of the track means showing several dispositions of a bobbin carrier as it traverses this section.

Upon despatch, each bobbin carrier 18 moves from a parking area 50 and stops adjacent the tube supply station 19, for example by engaging a latching device provided at the station 19, such as latching device 32 provided on the transfer device 29 described below, whereupon an empty tube 27 is transferred from the supply station 19 to each peg 20 by a transfer device 28 in a similar manner to the transfer of packages 13 to the bobbin carriers 18 by the transfer device 29 as described below. The transfer device 28 may also mark each tube 27 with an identification mark if desired. This transfer device is of a nonessential nature. A conventional transfer device is exemplified by GB 2236768 but the transfer device shown therein is used in connection with another structure that is unlike the combined structure of the present invention. The bobbin carriers 18, loaded with empty tubes 27, are then released from the station 19 and proceed to the machine 11. At the machine 11 there is provided a bobbin transfer device 29, see FIG. 2, which travels from the control end 25 towards the drive end 53 on rails 30 provided on the floor along the machine side 15, to stop adjacent a vertical column of three wound packages 13 by sensing a magnetic marker provided on the machine 11. A bobbin carrier 18 travels along the rail 17 until it reaches the transfer device 29, whereupon it is stopped and is located in that position by engagement with a latching device 32 provided on the transfer device 29. The concept of a bobbin transfer device per se for winding machines is, of course, already generally known, as suggested in U.S. Pat. Nos. 4,615,493 or 4,923,132 as well as U.S. Pat. No. 3,987,974, but these are not, of course, in combination with other structural elements as utilized in accordance with the present invention. The transfer device 29 engages the three yarns as they travel upwardly to the packages 13 and draws those yarns into the path of a cutter (not shown) in the transfer device 29. The cutter is then activated and cuts the yarns, the issuing end being held adjacent to the cutter. The transfer cradles 33 extend and remove the packages 13 from the machine cradles 31, and take them into the transfer device 29. At the same time, three transfer pegs of a transfer mechanism (not shown) of the transfer device 29 extend from the transfer device 29 to grip the empty tubes 27 which are removed from the carrier pegs 20 and held on the pegs. The transfer with the empty tubes 27 thereon are aligned with, but vertically displaced from the axes of the wound packages 13. The packages 13 are then transferred to a duplicate set of transfer pegs of the transfer device, which then move vertically so that the empty tubes 27 are placed on the transfer cradles 33, which extend and place them into the machine cradles 31. The transfer mechanism again moves vertically and rotates through 90°, and the packages 13 are transferred to the carrier pegs 20. The latching device 32 is then retracted to release the bobbin carrier 18 which travels away from the machine 11 to the package receiving station 12. In doing so the bobbin carrier 18 passes a visual inspection station 51 at which off-quality packages 13 may be removed, together with any empty tubes 27. The bobbin carrier 18 may also pass through a package labelling station 52 at which details of the yarn in that package 13, are put onto the tube 27 on which the yarn is wound. At the package receiving station 12 another transfer device 34 transfers the packages 13 from the bobbin carrier 18 to the receiving station 12 in a similar manner to that described above. Transfer devices for unloading packages are generally known, for example, from U.S. Pat. No. 4,730,733, but the device in that patent is used in combination with structure other than that disclosed in connection with the present invention. Subsequently packages 13 are removed from the receiving station 12, again in a similar manner, by a further transfer means 49 and transported to a automatic packing and palletizing means (not shown). Meanwhile the transfer device 29 moves towards the drive end 53 to the next column of wound packages 13 on the machine 11, and the next bobbin carrier 18 is loaded with empty tubes 27 arrives at, and is located by the latching device 32 in position relative to, the transfer device 29. The exchange between wound packages 13 and empty tubes 27 by the transfer device 29 as described above is repeated, and this exchange operation continues until all of the wound packages 13 have been removed from the side 15 of the machine 11 and empty tubes 27 have been placed in all of the vacated machine cradles 31 at that side 15. As each column of wound packages is replaced by new tubes 27 in the machine cradles 31, the ends of the yarns are taken by the transfer device 29 from the holding position adjacent the cutter referred to above and introduced to the new tubes 27, and the processing of the yarn, including the winding of new packages 13 of processed yarn, is recommenced. The individual control device 24 notes the new start time of package winding so that the complete doffing procedure described above can be repeated after the pre-set package winding time has elapsed. Referring now to FIGS. 3 and 4, the bobbin carrier 18 is shown in greater detail. The bobbin carrier 18 comprises a body 35 having wheels 36 mounted thereon for rolling engagement with the track 17. At least one of the wheels 36 is driven by a motor 37 mounted on the body 35. Throughout the horizontal runs of the track 17 smooth wheels 36 will be adequate to drive the bobbin carrier 18 therealong, but for adequate drive up an inclined section 21 at one end of the machine 11, and adequate control of the bobbin carrier 18 as it travels down an inclined section 21 at the other end of the machine 11, a toothed wheel 38 is provided. The toothed wheel 38 is also driven by the motor 37 and engages a toothed rack 39 provided at least in the regions of the inclined sections 21. Since the torque required of the motor 37 to rotate the complete bobbin carrier 18 at the commencement of an inclined section 21 would be excessive, particularly when large, heavy packages 13 are being carried by the carrier 18, the spine 40 depending from the body 35 is provided with a pivot 41. This ensures that whatever the inclination of the body 35, the lower part 42 of the spine 40, on which the bobbin receiving pegs 20 are provided, can always remain substantially vertical. To prevent the packages 13 from falling off the pegs 20 while the bobbin carrier 18 is in transit, in particular along the elevated sections of the track 17, bobbin retaining means in the form of an upwardly directed protuberance 43 may be provided on the free end of each peg 20, particularly for plain tubes 47 as shown on the upper two pegs 20 in FIG. 3. Alternatively, particularly for bull or rolled nose tubes 48 having one end thereof folded back on itself as shown on the lowest peg 20, the peg 20 may be provided with an indent 43' in its upper surface spaced from the free end thereof sufficiently for the tube 48 to be retained thereon.

Figure 5:
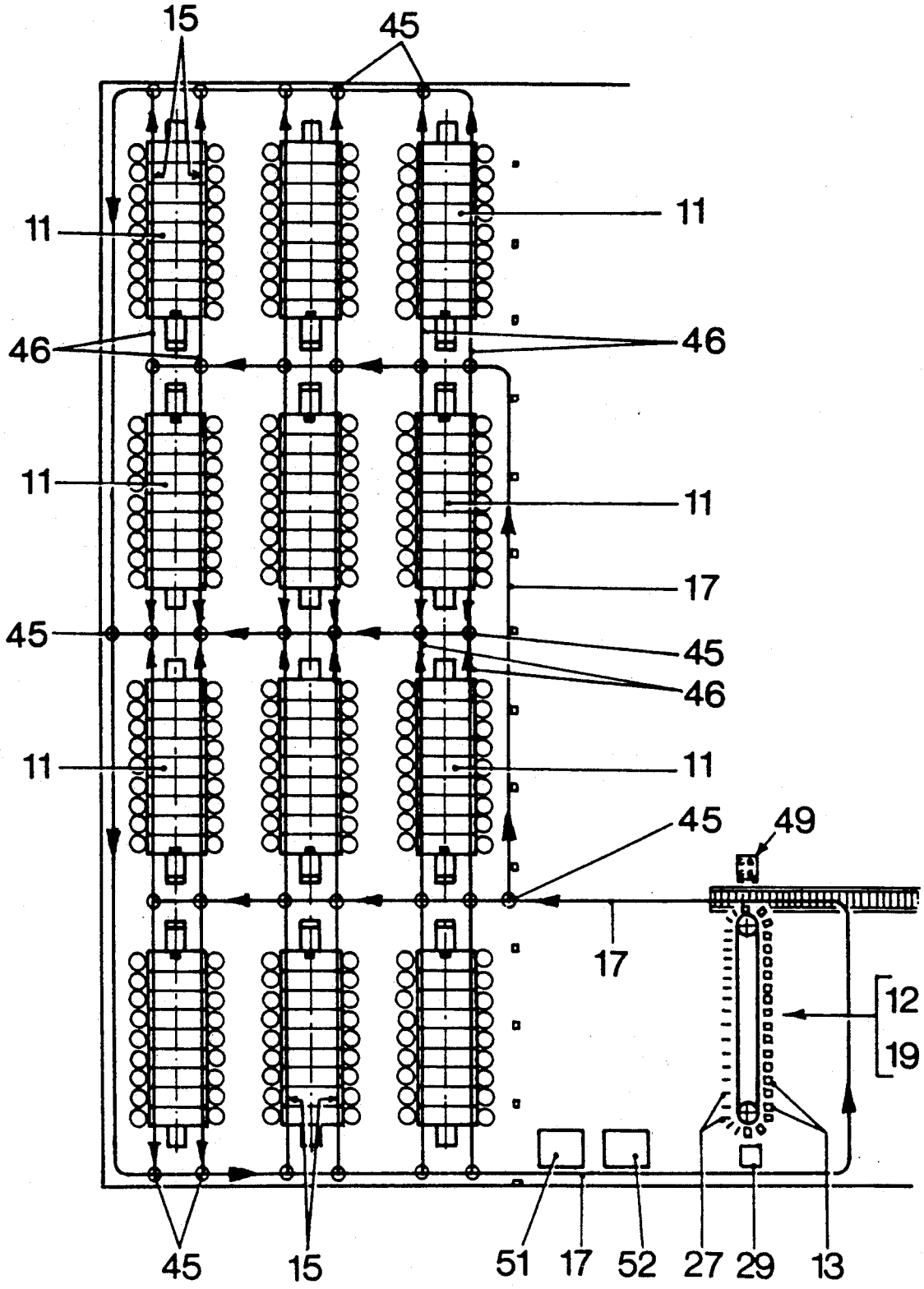
FIG. 5 is a schematic plan of a plant layout incorporating a second embodiment of transportation arrangement.

In the embodiment shown in FIG. 1 the track 17 has a branch 44 leading to and from each machine 11, which branch 44 sub-divides into two subbranches disposed on opposed sides of the machine 11. Such an arrangement requires switching devices, like those used to switch a train from one track to another with railroads, which may be controlled by the individual control means 24 to direct the incoming bobbin carriers 18 to and the outgoing bobbin carriers 18 from, the side 15 of the machine 11 which is being doffed at that particular time. Alternatively, as shown in FIG. 5, a respective turntable section 45 in the track 17 at each end of each side 15 of each machine 11 may be provided to transfer the bobbin carriers 18 from and to the main track 17 to and from a subbranch 46 extending along the sides 15 of the machine 11. Such turntables 45 could be controlled by the individual control devices 24, and/or the plant control device 26 to turn as required to connect the main track 17 with the appropriate subbranch track 46.

Other arrangements in accordance with the invention will be readily apparent to persons skilled in the art. For example, as shown in FIG. 5, the bobbin supply station 19 and the package receiving station 12 may be combined, and a single transfer device, of the type 29 provided at the machine 11 and described above, could be provided to replace empty tubes 27 at such a combined station by wound packages 13. As an alternative to having subbranches of track 17 at opposed sides of the machine 11, with the incoming and outgoing main tracks 17 at opposed ends of the machine 11, the incoming and outgoing main tracks 17 could be at one end of the machine 11 and a single branch 44 could pass around the machine 11 along the two sides thereof in turn.

What is claimed is:

1. A bobbin transportation arrangement, in combination with at least one yarn processing machine having a lengthwise side, a plurality of yarn processing positions disposed along the lengthwise side, and means for winding packages of yarn onto tubes disposed at the yarn processing positions, comprising track means and a plurality of bobbin carriers each adapted to travel therealong, the track means being disposed to pass adjacent the lengthwise side of the machine and each bobbin carrier having at least one bobbin receiving means, and also comprising first transfer means for transferring at least one bobbin from the machine to said bobbin receiving means when a bobbin carrier is located adjacent a yarn processing position, and control means for determining that packages are wound on the tubes disposed at the yarn processing positions, and for initiating travel of the plurality of bobbin carriers in sequence to the machine to receive the bobbins and to transport those bobbins from the machine.

2. A bobbin transportation arrangement according to claim 1, comprising a package receiving station, and second transfer means for transferring a bobbin from a bobbin carrier to the package receiving station when that bobbin carrier is adjacent to the package receiving station.

3. A bobbin transportation arrangement according to claim 1, wherein the first transfer means includes means for transferring at least one bobbin from the machine to a bobbin carrier carrying empty tubes thereon which is located adjacent a yarn processing position, and wherein said first transfer means also includes means for transferring an equal number of empty tubes from the bobbin carrier to the machine.

4. A bobbin transportation arrangement according to claim 3, comprising an empty tube supply station adjacent said track means, means for moving said bobbin carrier along said track means and third transfer means for transferring at least one empty tube from the empty tube supply station to a bobbin carrier when that bobbin carrier is located adjacent the empty tube supply station on said track means.

5. A bobbin transportation arrangement according to claim 1, wherein the control means includes means for determining the time to initiate the travel of the first of the plurality of bobbin carriers to the machine, the time interval between each of the successive bobbin carriers, and the number of bobbin carriers required by the machine at that time.

6. A bobbin transportation arrangement according to claim 1, wherein the number of bobbin receiving means possessed by the plurality of bobbin carriers despatched to the machine in response to operation of the control means is equal to the number of wound packages present at the yarn processing positions.

7. A bobbin transportation arrangement according to claim 1, wherein the yarn processing machine has package winding means disposed in a plurality of rows extending along the side of the machine, and each bobbin carrier has at least one bobbin receiving means in respect of each row, and wherein the rows are substantially vertically spaced, and the bobbin receiving means are disposed with substantially vertical spacing corresponding with that of the rows.

8. A bobbin transportation arrangement according to claim 1, wherein the machine has a drive end and a control end, and the bobbin carriers travel adjacent a lengthwise side of the machine from the control end towards the drive end, whereby the first transfer means transfers bobbins from yarn processing positions adjacent the control end and subsequently from positions nearer the drive end.

9. A bobbin transportation arrangement according to claim 1 wherein the machine has two opposed sides, each with yarn processing positions thereon, and the track means includes a branch adjacent to each side of the machine.

10. A bobbin transportation arrangement according to claim 9, wherein the control means includes means for sensing that the yarn processing positions on one side of the machine contain wound packages and means for directing the plurality of bobbin carriers to that side of the machine.

11. A bobbin transportation arrangement according to claim 1, wherein the track means is elevated to a first height in regions remote from the machine, and passes adjacent a longitudinal side of the machine at a second height at which the or each bobbin receiving means is substantially at the same height as a package winding means of the machine.

12. A bobbin transportation arrangement according to claim 11, wherein the second height is less than the first, elevated, height.

13. A bobbin transportation arrangement according to claim 1, wherein the machine has two ends, and the track means comprises an inclined section disposed adjacent each end of the machine.

14. A bobbin transportation arrangement according to claim 13 comprising drive means for each bobbin carrier, and the track means comprises toothed track means at least along the inclined sections, wherein the drive means comprises toothed wheel driving means operable to engage the toothed track means.

15. A bobbin transportation arrangement according to claim 13, wherein each bobbin carrier depends from the track means.

16. A bobbin transportation arrangement according to claim 15, wherein each bobbin carrier comprises a pivot whereby the bobbin receiving means on a bobbin carrier remain depending from the track means with substantially constant vertical spacing therebetween as the bobbin carrier traverses the track means and the inclined sections thereof.

17. A bobbin transportation arrangement according to claim 16, comprising latching means operable to locate a depending bobbin carrier in a position adjacent a yarn processing position.

18. A bobbin transportation arrangement according to claim 1, comprising drive means for each bobbin carrier.

* * * * *

UNITED STATES PATENT AND TRADEMARK OFFICE

CERTIFICATE OF CORRECTION

PATENT NO. : 5,244,160

DATED : September 14, 1993

INVENTOR(S) : Malcolm G. Hinchliffe, et al.

It is certified that error appears in the above-indentified patent and that said Letters Patent is hereby corrected as shown below:

Column 5, line 10, after "transfer", insert --mechanism then rotates through 90° so that the transfer pegs--.

Signed and Sealed this

Twenty-first Day of June, 1994

*Attest:*

Bruce Lehman

BRUCE LEHMAN

*Attesting Officer*

*Commissioner of Patents and Trademarks*